United States Patent [19]

Yamamoto et al.

[11] Patent Number: 4,920,620

[45] Date of Patent: May 1, 1990

[54] BUCKLE DEVICE WITH SWITCH FOR DETECTING TONGUE LOCK

[75] Inventors: Shigemi Yamamoto, Chigasaki; Toshiaki Seto, Fujisawa, both of Japan

[73] Assignee: Nippon Seiko Kabushiki Kaisha, Tokyo, Japan

[21] Appl. No.: 272,642

[22] Filed: Nov. 17, 1988

[30] Foreign Application Priority Data

Nov. 26, 1987 [JP] Japan ..... 62-178857[U]

[51] Int. Cl.[5] ..... A44B 11/25

[52] U.S. Cl. ..... 24/641; 24/651; 200/61.58 B

[58] Field of Search ..... 24/641, 633, 637, 651; 200/61.58 B

[56] References Cited

U.S. PATENT DOCUMENTS

| | | | |
|---|---|---|---|
| 3,833,781 | 9/1974 | Rumpf . | |
| 3,871,090 | 3/1975 | Romanzi, Jr. et al. | 24/641 |
| 3,956,603 | 5/1976 | Fisher . | |
| 4,000,385 | 12/1976 | Colasanti . | |
| 4,004,115 | 1/1977 | Esner | 200/61.58 B |
| 4,451,958 | 6/1984 | Robben et al. | 24/641 |
| 4,571,471 | 2/1986 | Haglund . | |
| 4,587,696 | 3/1986 | Ueda et al. | 24/637 |
| 4,608,469 | 8/1986 | Doty | 200/61.58 B |
| 4,624,034 | 11/1986 | Ishiguro et al. | 24/641 |
| 4,703,542 | 11/1987 | Hirata et al. . | |
| 4,797,984 | 1/1989 | Seto et al. | 24/641 |

FOREIGN PATENT DOCUMENTS

| | | |
|---|---|---|
| 0141734 | 5/1985 | European Pat. Off. . |
| 2903230 | 7/1980 | Fed. Rep. of Germany . |
| 2386278 | 3/1978 | France . |
| 2071753 | 9/1981 | United Kingdom . |
| 2088465 | 6/1982 | United Kingdom . |
| 2166187 | 4/1986 | United Kingdom . |

*Primary Examiner*—Victor N. Sakran

*Attorney, Agent, or Firm*—Hedman, Gibson, Costigan & Hoare

[57] ABSTRACT

A buckle device with a switch for detecting tongue-lock comprises a base, a latch piece supported on the base so as to move between a tongue-lock position and a tongue-unlock position, a lock plate provided so as to move between an engaged position at which the latch piece remains stationary in the tongue-lock position and a disengaged position which permits movement from the tongue-lock position of the latchpiece, such that the lock plate moves to the engaged position following the movement of the latch piece to the tongue-lock position, a release button for setting the lock plate in the disengaged position; and a switch assembly for detecting whether the lock plate is located in the engaged position or not.

13 Claims, 2 Drawing Sheets

BUCKLE DEVICE WITH SWITCH FOR DETECTING TONGUE LOCK

FIELD OF THE INVENTION

The present invention is related to a buckle device suitable for installation on a seatbelt to be utilized, for example, on an automobile, more specifically a buckle device which is equipped with a switch for detecting a tongue lock.

BACKGROUND OF THE INVENTION

Many conventional buckle devices are provided with a switch means for detecting whether or not a tongue is located in the lock status with the latch piece of the buckle device. However, these devices are switch-activated through a mechanism which utilizes the movement of a tongue, or the movement of a slider which is in turn moved by means of the tongue, and can only detect whether the tongue is located in the buckle device or not. Therefore, when the tongue is inserted into the buckle device, consideration must be always given to the so-called "false latch" or "partial engagement" status wherein the tongue and latch piece are not correctly engaged. Therefore a system is desired wherein it is possible to reliably detect that the tongue and latch piece are securely engaged or interlocked.

SUMMARY OF THE INVENTION

An object of the present invention is to provide, with due consideration to the drawbacks of such conventional devices, a buckle device provided with a switch means which detects more directly and reliably whether or not a tongue and latch piece are located in a locked state.

These objects are accomplished in the present invention by the provision of a buckle device comprising a base, a latch piece supported on the base so as to move between a tongue-lock position and a tongue-unlock position, an engagement means provided so as to move between an engaged position at which the latch piece in the tongue-lock position remains stationary and a disengaged position which permits movement from the tongue-lock position of the latch piece, such that the engagement means moves to the engaged position following the movement of the latch piece to the tongue-lock position, a release means for setting the engagement means in the disengaged position, and a switch means for detecting whether or not the engagement means is located in the engaged position.

With the buckle device of the present invention, because the configuration is such that the switch is activated by means of this movement of the engagement means which will not move from the disengaged position to the engaged position unless the latch piece attains the state in which it is locked with the tongue, the detection is made more directly and reliably whether or not both the tongue and the latch piece are located in the locked state.

BRIEF DESCRIPTION OF THE DRAWINGS

These and other objects, features, and advantages of the present invention will become more apparent from the following description of the preferred embodiments taken in conjunction with the accompanying drawings, in which.

DETAILED DESCRIPTION OF THE PREFERRED EMBODIMENTS

Figure 1:
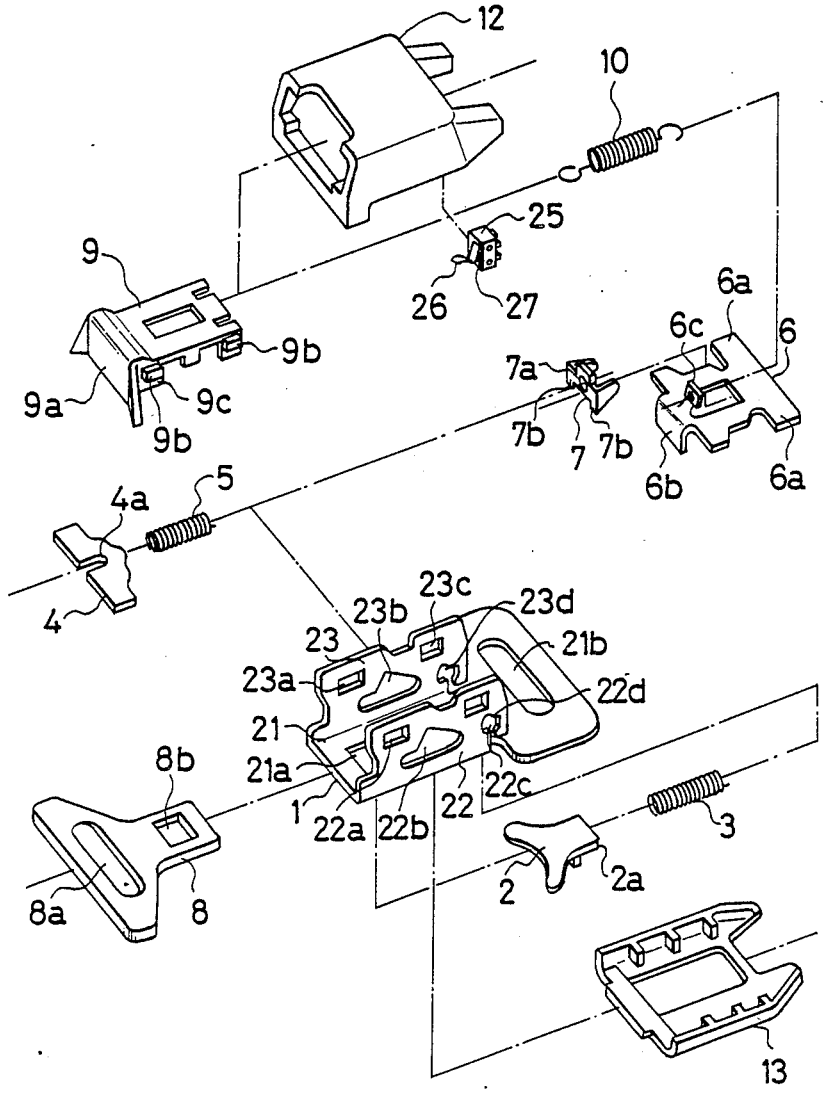
FIG. 1 is an exploded perspective view of an embodiment of the present invention.

Now referring to FIG. 1, a buckle device of the present embodiment comprises a base 1, a slider 2, a push-out spring or first biasing means 3, a lock plate or engagement means 4, a lock plate spring or second biasing means 5, a hook-shaped latch piece 6 and a locking guide 7, which cooperate to receive a tongue 8, and are operated through a release means or push button 9 with a latch spring or third biasing means 10. The base 1 is provided with a foundation section 21 and a pair of side plate sections 22 and 23 which are opposingly positioned and standing upright on the sides of the foundation section 21. It will be noted that the base 1 and the side plate sections 22 and 23 conjointly form a channel shape. Formed in the foundation section 21 are a guide section **21*a* which supports the slider 2, so that the slider 2 can slide between an advanced position and a retracted position, and an elongated opening 21*b* for securing a webbing. The slider 2 is subjected to the force of the push-out spring 3 to expel or eject the tongue 8. The push-out spring 3 is inserted at the rear of the guide section 21*a* (to the right in FIG. 1), specifically at the rear end of the slider 2 to energize or bias the slider 2** in the direction of the advanced position.

Formed in series in the side plate sections 22, 23 are, from the front side to the right direction in FIG. 1, a pair of elongated openings **22*a*, 23*a* for receiving a first projection 9*b* of the push button 9 to prevent withdrawal of the push button 9, a pair of openings 22*b*, 23*b* for guiding the engagement means or lock plate 4, another pair of elongated openings 22*c*, 23*c* for receiving a second projection 9*b* of the push button 9 to prevent withdrawal of the push button 9, and a pair of latch piece support openings 22*d*, 23*d* for receiving a pair of ear sections 6*a* of the latch piece 6**.

The lock plate 4 which acts as the engagement means is inserted at its both ends into the openings **22*b*, 23*b*, which have a composite shape of an elongated opening section extending to the left-right directions in the drawings and a fan-shaped or sector-shaped opening section on the back of the elongated opening section. The lock plate 4 is movably provided on the latch piece 6 and energized or biased in the direction of the advanced position or front engaging position by the lock plate spring 5 which is mounted at its leading edge to the lock plate 4**.

Since the pair of ear sections **6*a* of the hook-shaped latch piece 6 are rotatably inserted into the openings 22*d*, 23*d*, the latch piece 6 is supported so as to swing between first and second angular positions around an axis extending through the pair of ear sections 6*a*. The tip of the latch piece 6 is bent to form a lock section 6*b* which projects downward. This latch piece 6 has also a square opening in its center section. Formed on the front edge of this square opening is a vertical projection 6c to which the lock plate spring 5 is connected. On the other hand, integrally mounted on the rear edge of this square opening is the plastic locking guide 7 which has a projection 7a on which the rear edge of the lock plate spring 5 is capped. The locking guide 7 has also a pair of legs 7b, so that the push out spring 3 can be moved without hindrance between the legs 7b, on one hand, and, in addition, the locking guide 7 is mounted on the latch piece 6 such that the legs 7b of the locking guide 7 contact the rear edge surface 2a of the slider 2 when the slider 2 is retracted. Thus, the locking guide 7 together with the slider 2 form a means for bringing the latch piece 6 forcibly to the tongue-lock position when the tongue 8 is inserted into the base 1**.

Incidentally, since the locking guide 7 is integrally mounted to the latch piece 6, when the lock section 6b is referred to as a first leg, the leg 7b of the locking guide 7 can be referred to as a second leg of the latch piece 6.

The lock plate or engagement means 4 has a yoke-shaped section, and an indented section 4a is formed between the ends of the yoke-shaped section. The indented section 4a of the lock plate 4 is fitted onto the root section of the projection 6c of the latch piece 6, so that the projection 6c can relatively move in the indented section 4a, in other words that the lock plate 4 is guided with a sliding movement laterally along the top surface of the latch piece 6.

On the side plates 22, 23 of the base 1, the release means or push button 9 is mounted so as to slide in the left-right directions in FIG. 1. The push button 9 comprises an operating surface 9a; the first and second projections 9b adapted to be inserted into the elongated openings 22a, 23a and 22c, 23c of the side plates 22, 23 to prevent the push button 9 from being withdrawn from the base 1; and an operating section 9c which, when the push button 9 is pushed in the rear direction, engages the lock plate 4, causing the lock plate 4 to slide in the rear direction resisting the force of the lock plate spring 5.

The latch spring 10 is bridgingly inserted between the rear edge of the push button 9 and the projection 6c of the latch piece 6. In this way, the push button 9 is energized or biased in the direction of the front non-operating position, while the latch piece 6 is also energized or biased in the direction of the tongue-unlock position, such that the latch piece 6 can be swung upward, specifically from the first angular position or elongated opening section to the sector shaped opening section or second angular position. It will be noted that the lock plate spring 5 and the latch spring 10 are arranged in a stagger shape.

Figure 5:
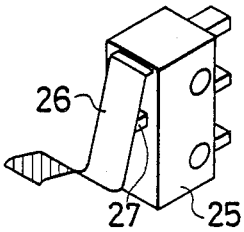
FIG. 5 is an enlarged perspective view of the switch assembly.

Further, an upper cover 12 is provided to cover or enclose the above-mentioned members including the base 1 and the push button 9. Mounted to the inner surface of the upper cover 12, specifically adjacent to the side plate section 22 or 23, is a switch assembly 25 which has an actuator 26 extending downward in an almost J-shape and a switch 27 adapted to be activated by the actuator 26. FIG. 5 is an enlarged view of the switch assembly 25.

A lower cover 13 is provided to cooperate with the upper cover 12 to cover the above-mentioned members, with the exception of the operating surface 9a of the push button 9 and the insertion port of the tongue 8.

The tongue 8 has a webbing-insertion opening 8a and a square opening 8b. When the tongue 8 is inserted between the foundation section 21 of the base 1 and the latch piece 6, the lock section 6b of the latch piece 6 is inserted into the square opening 8b, so that the tongue is locked.

Figure 4:
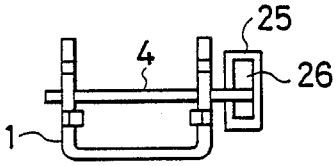
FIG. 4 is a front elevational view showing the relationship between the lock plate and the switch assembly.

The positional relationship of the lock plate 4 and the switch assembly 25 seen from the front of the base 1 is shown in FIG. 4. It will be moted that the lock plate 4 comes into contact with the switch 26.

The operation of the embodiment in the above configuration will now be explained.

Figure 2:
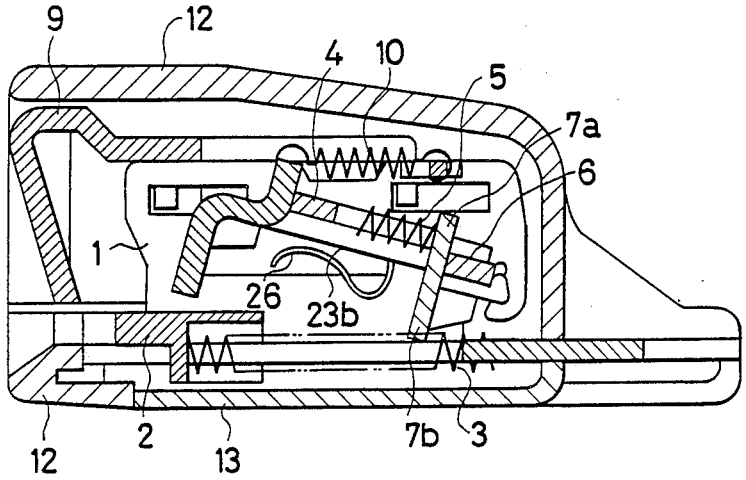
FIG. 2 is a partly cross-sectioned explanatory view of this embodiment in the state where the tongue is not locked.

In the tongue-unlocked state indicated in FIG. 2 where the latch piece 6 and the lock plate 4 are located in the second angular position, the latch piece 6 is positioned in the tongue-unlock position while the push button 9 in an inactive or non-operating position, which is achieved due to the action of the latch spring 10. The slider 2 is pressed by the push-out spring 3, and is located in the advanced position set close to a tongue insertion port. The advanced position of the slider 2 is set in such a way, a coin or similar foreign object can be prevented from entering into the interior from the tongue-insertion port, and even if a foreign object enters, the foreign object is pushed to the outside.

When entering the tongue-unlocked state, the lock plate 4 is slided from the advanced position to the retracted position on the latch piece 6, in other words, from the elongated opening section or first angular position to the sector-shaped opening section or second angular position, where the lock plate 4 is forced to the front edge of the sector-shaped section of the openings 22b, 23b by means of the lock plate spring 5.

In this state, the actuator 26 (in FIG. 2 only the actuator 26 is shown in the switch assembly 25) does not contact the lock plate 4. Accordingly, the switch 27 is projected to the outside as shown in FIG. 5. Accordingly, the switch 27 is placed in the ON state (or in the OFF state in a case), so that the tongue 8 and latch piece 6 are detected in the unlocked state.

As the tongue 8 is inserted into the buckle which is located in the state shown in FIG. 2, first the slider 2 is pushed in the direction of the retracted position under a tongue insertion force. At the point where the tongue 8 is almost completely inserted, the rear edge surface 2a of the slider 2 first contacts the legs 7b of the guide 7 which is integrated with the latch piece 6, and the latch piece 6, opposed to the energization or biasing force of the spring 10 starts to move downward to the tongue-lock position. Following the latch piece 6, the lock plate 4 moves downward, and at a certain point contacts the actuator 26.

At this time, however, because the switch 27 is not completely pushed in, the tongue lock state is not yet detected by the switch assembly 25. Also, the tongue 8 is not locked by the latch piece 6, and if the insertion of the tongue 8 is discontinued, the conditions revert to the status indicated in FIG. 2.

When the tongue 8 is further pushed deep into the buckle until the slider 2 completely reaches the retracted position, simultaneously the latch piece 6 comes into the first angular position, and the lock section 6b of the latch piece 6 enters the square opening 8b of the tongue 8, and the tongue 8 is completely locked.

At this time, the lock plate 4, which moves integrally downward with the latch piece 6, is released from the front edge of the sector-shaped opening section of the openings 22b, 23b, and clicked into the elongated opening section. Whereupon, according to the energization of the spring 5, the lock plate 4 enters this elongated opening section and reaches the engagement or interlocking position. It will be noted that the edges of the sector-shaped opening section and the elongated opening section serve as a cam surface, while the lock plate serves as a follower. Therefore, by means of the lock plate 4 which comes to the engagement or interlocking position, the latch piece 6 is positively prevented from jumping up into the tongue-unlocked position, and even if subjected to shock at the time the tongue is locked, the release of the lock is prevented.

Figure 3:
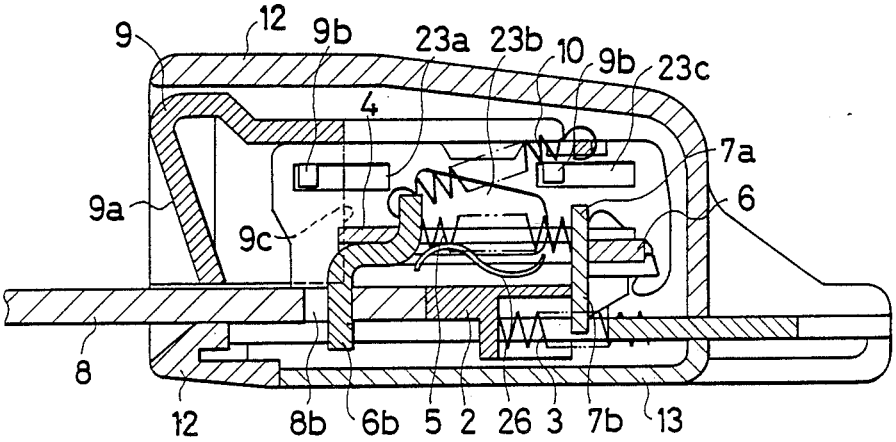
FIG. 3 is a partly cross-sectioned explanatory view of this embodiment in the state where the tongue is locked.

Here, as shown in FIG. 3 where the latch piece 6 and the lock plate 4 are located in the first angular position, the actuator 26 (only the actuator 26 is shown in FIG. 3) is pressed well down by the lock plate 4, and the switch 27 of the switch assembly 25 is completely forced in. Accordingly, the switch 27 is placed in the OFF state (or in the ON state in the case where it is in the OFF state in FIG. 2), so that the locked state of the tongue 8 and the latch piece 6 is detected. Accordingly, it can be said that the actuator 26 is positioned so that only when the latch piece 6 is located in the tongue-lock position with the engagement means or lock plate 4 fully forcing the actuator 26, the switch 27 is forced to cause the switch assembly 25 to output a detection signal.

In this tongue-locked state, the upper cover 12 is extended well in the forward direction as shown in FIG. 3, and its leading end comes to substantially the same position as that of the push button 9, so that even if, for example, a bulb of 23 mm diameter or greater contacts the push button 9, the lock is not released. Specifically, if an elbow, for example, contacts the operating surface 9*a*, inadvertent release of the lock cannot take place.

To release the lock, the push button 9 is pushed to the operating position in the rear direction. Whereupon, the lock plate 4 is pushed along the cam surface of the elongated opening section and down from the elongated opening section to the sector-shaped opening section of the openings 22*b*, 23*b* by the operating section 9*c* of the push button 9, and then the latch piece 6 is caused to spring up, together with the lock plate 4, by the latch spring 10 which is always energized in the upward direction (now, a force exerted on the push button 9 is added to the biasing force of the latch spring 10), and the lock plate 4 is elevated until it abuts the upper inclined surface of the sector-shaped opening section of the openings 22*b*, 23*b*. The latch piece 6 then reaches the tongue-unlock position and the lock is released. At this time, the tongue 8 is expelled by the movement of the slider 2 which is forced to the advanced position. These actions are mutually related, and the slider 2 advances and is released from the guide 7, so that the latch piece 6 can swing in the upward direction. It then reverts to the status shown in FIG. 2.

As can be understood from FIG. 3 with reference to the lock release, because the swing center axis of the latch piece 6 is located at the rear of the lock section 6*b*, and the lock section 6*b* protrudes in the downward direction, when action is taken to draw out the tongue 8, a torque is produced which tends to move the latch piece 6 in the direction of the tongue-unlock position, causing the tongue 8 to be withdrawn. In addition, because the latch piece 6 is energized in the direction of the tongue-unlock position, the lock plate 4 is detached from the elongated opening section of the openings 22*b*, 23*b* by the movement of the push button 9, and at the same time the lock is released. In this way the lock is easily released.

In addition, when the tongue is inserted, a space is created between the slider 2 and the guide 7 which is formed integrally with the latch piece 6. With the tongue 8 inserted, it is possible to lock the tongue 8 without touching the latch piece 6, or more specifically, the guide 7, so that only a light pressure is required to insert the tongue 8.

Furthermore, as previously outlined, a pair of the projections 9*b* are provided at the front of the push button 9, and another pair at the back. These are inserted in the elongated openings 22*a*, 23*a*; 22*c*, 23*c* on the base 1, so that when a shock occurs, even if the covers 12, 13 are damaged, the push button 9 is not separated from the base 1, and a malfunction of the button 9 is easily prevented.

In the above manner, in the present invention, the switch is activated by the lock plate or engagement means which reaches the engaged position following the movement of the latch piece to the lock position, so that the locked and unlocked state of the tongue and latch piece are reliably detected.

What is claimed is:

1. A buckle device with a switch for detecting tongue-lock comprising:

a base;

a latch piece supported on said base so as to move between a tongue-lock position and a tongue-unlock position;

an engagement means provided so as to move between an engaged position at which said latch piece remains stationary in said tongue-lock position and a disengaged position which permits movement out of said tongue-lock position of said latch piece, such that said engagement means moves to said engaged position following said movement of said latch piece to said tongue-lock position;

a release means for setting said engagement means in said disengaged position; and a switch assembly having an actuator and a switch for detecting whether said engagement means is located in said engaged position or not; and said actuator positioned so that only when said latch piece is located in said tongue-lock position with said engagement means fully forcing said actuator, said switch is forced to cause said switch assembly to output a detection signal.

2. The buckle device of claim 1, wherein said engaged position and disengaged position are defined by an opening provided in said base, wherein said opening has a first cam surface to retain said engagement means in said engaged position, and a second cam surface to retain said engagement means in said disengaged position, and said engagement means has a cam follower to follow said first and second cam surfaces.

3. The buckle device of claim 2, wherein said opening comprises an elongated opening section for said first cam surface and a sector-shaped opening section for said second cam surface.

4. The buckle device of claim 1, wherein said base has a pair of side plate sections, said engaged position and disengaged position are defined by an opening provided in said pair of side plate sections, said opening comprises an elongated opening section and a sector-shaped opening section, wherein a first cam surface is formed in said elongated opening section to retain said engagement means in said engaged position, a second cam surface is formed in said sector-shaped opening section to retain said engagement means in said disengaged position, and said engagement means has a yoke-shaped section to have a cam follower at each end of said yoke-shaped section to follow said first and second cam surfaces.

5. A buckle device with a switch for detecting tongue-lock comprising:

a base having a slider and a first biasing means to force said slider in a first direction, said base having a insertion portion into which a tongue is inserted in a direction opposite to said first direction, so that said tongue comes into contact with said slider and moves said slider against said first biasing means;

a latch piece having first and second legs, said latch piece adapted to move between first and second angular positions, wherein in said first angular position, said first leg is placed into an interlocking relationship with said tongue while said second leg contacts said slider, whereas in said second angular position, said first leg is placed out of said interlocking relationship with said tongue detached from said slider;

an engagement means movably provided on said latch piece and adapted to move together with said latch piece between first and second angular positions, said engagement means having a second biasing means to bias said engagement means in a direction to an advanced position from a retracted position;

a third biasing means for exerting a biasing force to move said latch piece from said first angular position to said second angular position;

a control means having a first control section to retain said engagement means to keep said latch piece in said first angular position against said third biasing means, and a second control section to retain said engagement means to keep said latch piece in said second angular position against said second biasing means;

a switch assembly having an actuator and a switch for detecting that said engagement means is located in said first angular position, said actuator positioned so that only when said latch piece is located in said first angular position with said engagement means fully forcing said actuator, said switch is forced to cause said switch assembly to output a detection signal.

6. The buckle device of claim 5, wherein said control means is formed by an opening provided in said base, wherein said first control section is a first cam surface of said opening, said second control section is a second cam surface of said opening, and said engagement means has a cam follower to follow said first and second cam surfaces.

7. The buckle device of claim 6, wherein said opening comprises an elongated opening section for said first cam surface and a sector-shaped opening section for said second cam surface.

8. The buckle device of claim 5, wherein said base has a pair of side plate sections, said control means is defined by an opening provided in said pair of side plate sections, said opening comprises an elongated opening section and a sector-shaped opening section, wherein said first control section is a first cam surface of said elongated opening section, said second control section is a second cam surface of said sector-shaped opening section, and said engagement means has a yoke-shaped section to have a cam follower at each end of said yoke-shaped section to follow said first and second cam surfaces.

9. The buckle device of claim 8, wherein said yoke-shaped section has an indented section between said ends, said latch piece has a projection to which said third biasing means is connected, and said projection is positioned in said indented section, so that said projection is relatively move in said indented section when said engagement means is moved between said advanced position and said retracted position.

10. The buckle device of claim 5, further comprising a release means and said third biasing means is connected to said release means and said latch piece, so that a force exerted on said release means is added to said biasing force of said third biasing means.

11. The buckle device of claim 10, wherein an enclosure is provided to enclose said buckle device, so that said release means is prevented from being subjected to unintentional strong forces.

12. A buckle device with a switch for detecting tongue-lock comprising:

a base having a pair of side plate sections;

a latch piece supported on said base so as to move between a tongue-lock position and a tongue-unlock position;

an engagement means provided so as to move between an engaged position at which said latch piece remains stationary in said tongue-lock position and a disengaged position which permits movement out of said tongue-lock position of said latch piece, such that said engagement means moves to said engaged position following said movement of said latch piece of said tongue-lock position.

a release means for setting engagement means in said disengaged position;

a switch assembly having an actuator and a switch for detecting whether said engagement means is located in said engaged position or not, said engaged position and disengaged position defined by an opening provided in said pair of side plate sections, such that said opening comprises an elongated opening section and a sector-shaped opening section, wherein a first cam surface is formed in said elongated opening section to retain said engagement means in said engaged position, a second cam surface is formed in said sector-shaped opening section to retain said engagement means in said disengaged position, and said engagement means has a yoke-shaped section to have a cam follower at each end of said yoke-shaped section to follow said first and second cam surfaces, said actuator positioned so that only when said latch piece is located in said tongue-lock position with one of said ends of said yoke-shaped section fully forcing said actuator, said switch is forced to cause said switch assembly to output a detection signal.

13. A buckle device with a switch for detecting tongue-lock comprising:

a base with a pair of side plate sections having a slider and a first biasing means to force said slider in a first direction, said base having an insertion portion between said pair of said plate sections into which a tongue is inserted in a direction opposite to said first direction, so that said tongue comes into contact with said slider and moves said slider against said first biasing means;

a latch piece having first and second legs, said latch piece adapted to move between first and second angular positions, wherein said first angular position, said first leg is placed into an interlocking relationship with said tongue while said second leg contacts said slider, whereas in said second angular position, said first leg is placed out of said interlocking relationship with said tongue detached from said slider;

an engagement means movably provided on said latch piece and adapted to move together with said latch piece between first and second angular positions, said engagement means having a second biasing means to bias said engagement means in a direction to an advanced position from a retracted position, a third biasing means for exerting a biasing force to move said latch piece from said first angular position to said second angular position;

a control means having a first control section to retain said engagement means to keep said latch piece in said first angular position against said third biasing means, and a second control section to retain said engagement means to keep said latch piece in said second angular position against said second biasing means, said control means defined by an opening provided in said pair of side plate sections, such that said opening comprises an elongated opening section and a sector-shaped opening section, wherein said first control section is a first cam surface of said elongated opening section, said second control section is a second cam surface of said sector-shaped opening section, and said engagement means has a yoke-shaped section to have a cam follower at each end of said yoke-shaped section to follow said first and second cam surfaces;

a switch assembly having an actuator and a switch for detecting that said engagement means is located in said first angular position, said actuator positioned, so that only when said latch piece is located in said first angular position with one of said ends of said yoke-shaped section fully forcing said actuator, said switch is forced to cause said switch assembly to output a detection signal.

* * * * *